US005443041A

United States Patent [19]

Folsom et al.

[11] Patent Number: 5,443,041

[45] Date of Patent: Aug. 22, 1995

[54] HOT WATER TANK ASSEMBLY

[76] Inventors: B. Wayne Folsom, 3304 Sharer Rd., Tallahassee, Fla. 32312; Michael Truchon, Rte. 1, Box 123, Chancellor, Ala. 36316

[21] Appl. No.: 172,541

[22] Filed: Dec. 23, 1993

[51] Int. Cl.[6] ..... F24H 1/18; F22K 37/36

[52] U.S. Cl. ..... 122/379; 392/449; 122/234

[58] Field of Search ..... 122/13.2, 234, 379, 122/499, 4 A; 392/447, 449; 126/360 R, 361, 362; 220/565

[56] References Cited

U.S. PATENT DOCUMENTS

| | | | |
|---|---|---|---|
| 1,209,063 | 12/1916 | Steneck | 126/362 |
| 1,892,557 | 12/1932 | McCormick | 122/13.2 |
| 3,043,467 | 7/1962 | Schwebel | 122/379 |
| 3,045,654 | 7/1962 | Dell | 122/379 |
| 3,605,702 | 9/1971 | Thompson | 122/234 |
| 4,777,933 | 10/1988 | Ruark | 126/361 |
| 4,872,443 | 10/1989 | Ruark | 126/361 |
| 5,163,119 | 11/1992 | Windon | 392/449 |

*Primary Examiner*—Henry A. Bennett
*Assistant Examiner*—William C. Doerrler
*Attorney, Agent, or Firm*—Carnes, Cona, and Dixon

[57] ABSTRACT

The present invention provides for an improved hot water tank assembly. The improved hot water tank assembly is provided with a access port. This access port provides adequate space to remove accumulated sediment and debris from the interior area of the hot water tank. By removing sediment and debris from the interior area of the hot water tank a buildup of sediment on the elements will not occur. This will increase element efficiency and decrease operating costs. Element and hot water tank assembly life spans will both be increased. The present invention also provide for a tool having a unique design and configuration to assist in the process of removing sediment and debris from the interior of the hot water tank assembly.

6 Claims, 5 Drawing Sheets

HOT WATER TANK ASSEMBLY

BACKGROUND OF THE INVENTION

In a typical residential environment, the hot water heater is responsible for a large portion of a household's power consumption bill. Therefore, for a utility cost management plan to succeed, the hot water heater must be considered.

In order to save on the hot water bill, the hot water heater should be in top condition. A hot water heater that is electrically operated, typically has a one or two heating elements protruding into the water tank. As electricity is introduced, the elements become hot and heat the water within the tank. In order to efficiently operate the water heater, these elements must be kept in good shape.

However much the public desires to believe to the contrary, the residential water supply is not pure water. The water will typically contain impurities such as minerals, sediments, sand, debris, and the like. These impurities are especially pronounced in households that rely on well water and those located in coastal areas.

These impurities will settle on the bottom of the hot water tank and accumulate over time. The accumulation of sediment builds up on and cakes to the elements, especially the element located close to the bottom of the tank. A sediment buildup on the element decreases its efficiency and increases the cost of heating the water within the tank. As the accumulation of the sediment continues and the buildup on the elements increases, the elements become less and less efficient until they fail, necessitating a replacement. The sediment accumulation also decreases the useful life of the hot water tank itself.

What is needed is a way to be able to remove the sediment without adding to the purchase cost of the hot water tank assembly. One simple solution is to periodically remove the sediment, thereby preventing an accumulation within the tank and a buildup on the elements. However, the only opening available into present day hot water tanks is through the opening through which the element is inserted, a very small opening indeed. With such a small opening, a person desiring to remove debris would be required to use a small instrument such as a teaspoon. Such a process would be slow and inefficient and would discourage all but the extremely dedicated.

What is needed is a hot water tank assembly that has an opening in the tank that will permit a person to insert his hand directly into the tank. Such an assembly would give a person easy access into the interior of the hot water tank and would permit that person to remove accumulated sediment quickly and easily. With regular sediment removal, the elements would not experience a sediment buildup and would operate more efficiently as well as experience a longer life span. The result would a lower hot water bill and lower maintenance costs of both the elements and the tank assembly itself.

SUMMARY OF THE INVENTION

The present invention provides for a simple and easy means for cleaning the sediment and debris that accumulates in a hot water tank by installing an access port on the housing of a hot water tank assembly. The process of periodically cleaning and removing the waste and debris from the hot water tank decreases sediment buildup on the elements allowing them to operate more efficiently and at a lower cost. The life span of the elements and the hot water tank assembly is increased.

The improved hot water tank assembly of the present invention includes a conventional heating element, a water drain device, an insulating flange, an access port, a housing, a conventional water inlet valve, a conventional water outlet valve, and a conventional safety valve.

The housing is multi-layered and has an inner metal layer, an outer metal layer, and an insulating layer located between the inner and outer metal layer.

The insulating flange is located on the outer metal layer of the housing. The flange is provided with a central aperture and a plurality of slits. The water drain device is received in the aperture of the insulating flange.

A unique and inventive access port is provided in the inner metal layer. This access port provides a comfortable entrance to permit a person to remove the accumulated sediment within the hot water tank.

The present invention also provides for a tool to assist in the removal of the sediment. This tool has a specialized design and configuration which will collect the sediment effectively and efficiently.

Therefore, it is the object of the present invention to provide for an improved hot water tank assembly that will allow easy access to the interior area of a water tank within a hot water tank assembly in order to permit removal of accumulated sediment within the water tank.

It is another object of the present invention to provide for an improved hot water tank assembly that will operate more efficiently resulting in lower energy consumption.

It is another object of the present invention to provide for an improved hot water tank assembly that will have lower maintenance costs.

It is another object of the present invention to provide for an improved hot water tank assembly that will allow an individual to comfortably use a flashlight when cleaning the interior of the hot water tank assembly.

It is another object of the present invention to provide for an improved hot water tank assembly that is easy and inexpensive to fabricate and durable in operation.

It is another object of the present invention to provide for a tool that will assist in the removal of the sediment from the hot water tank.

It is a final object of the present invention to provide for a tool that is simple in design, small in size, efficient in operation, and easy to store.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
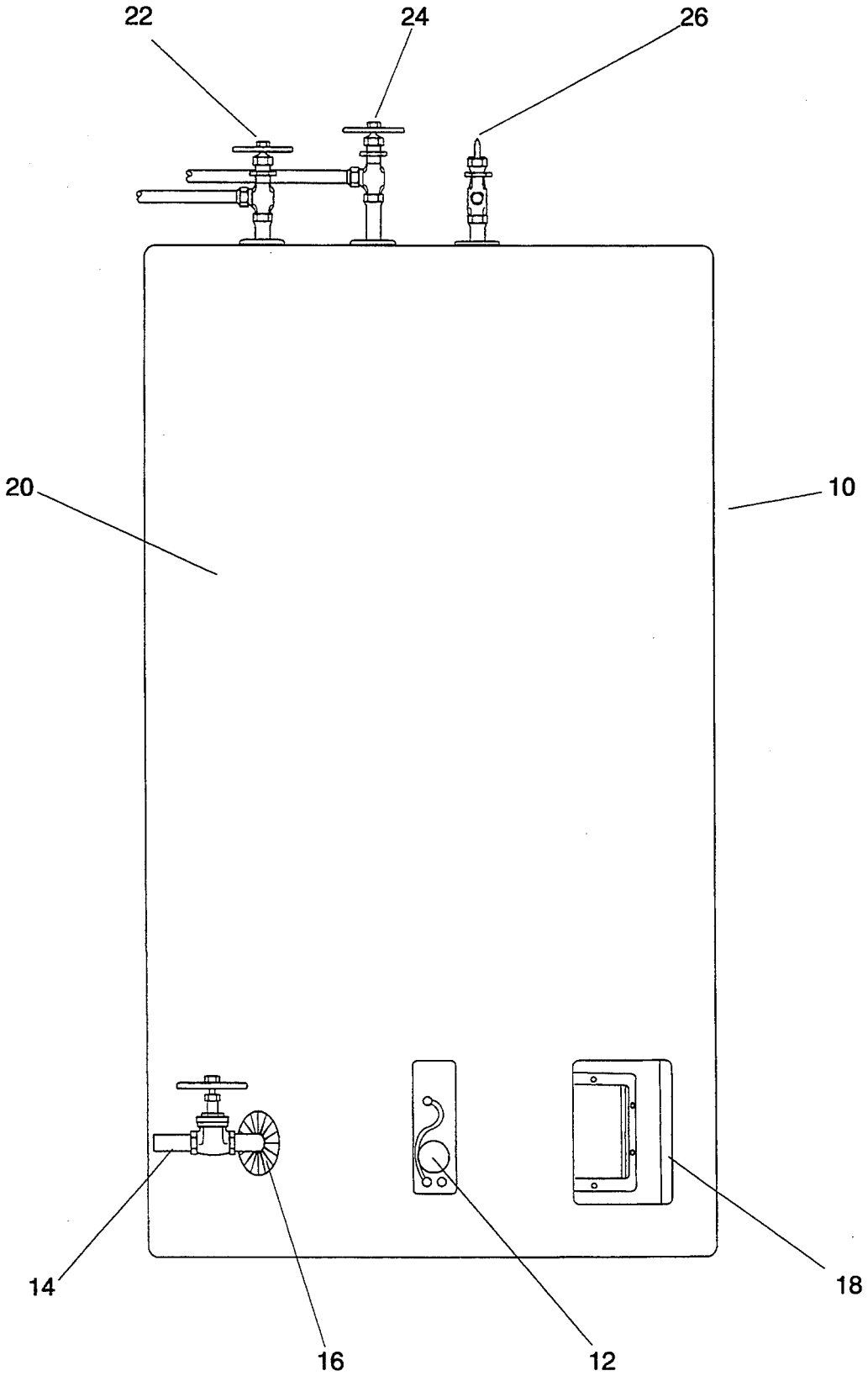
FIG. 1 is a front elevation view of the first embodiment of the hot water tank assembly of the present invention.
Figure 2:
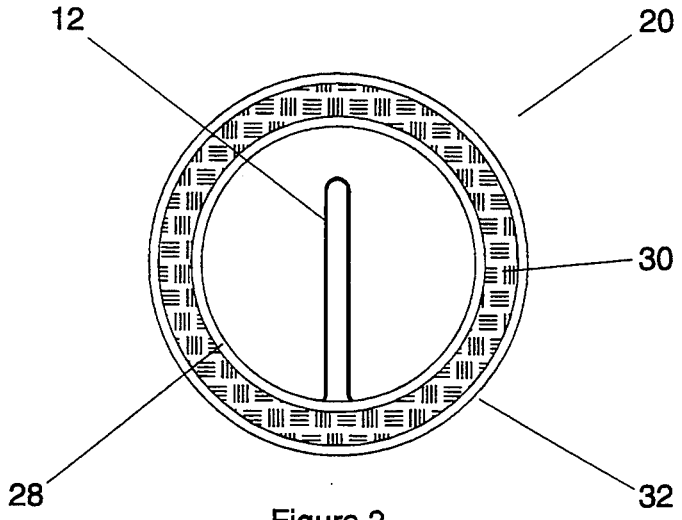
FIG. 2 is a cross-sectional view of the hot water tank assembly of the present invention taken along line 2—2 of FIG. 1.

FIGS. 1 and 2 illustrate various views of the first embodiment of the present invention. As illustrated in these figures, the hot water tank assembly 10 consists of a conventional heating element 12, a water drain device 14, an insulating flange 16, an access port 18, a housing 20, a conventional water inlet valve 22, a conventional water outlet valve 24, and a conventional safety valve The housing 20 is of a multi-layer construction, consisting of an inner metal layer 28, an outer metal layer 32, and a layer of fiber glass insulation 30 located between the inner and outer layers.

Figure 3:
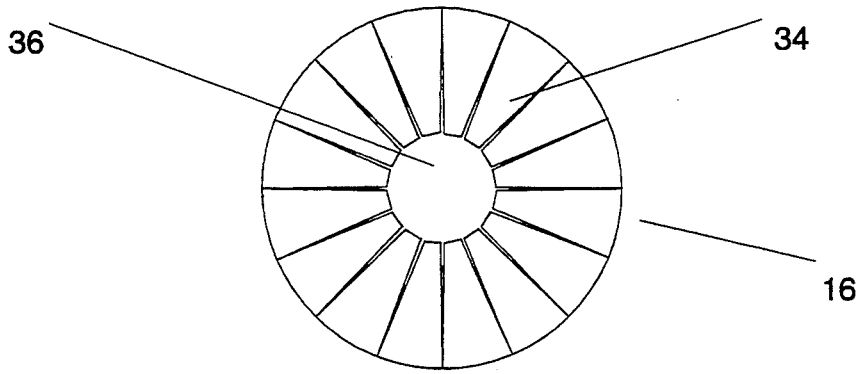
FIG. 3 is a detailed view of the insulating flange located on the improved hot water tank assembly of the present invention.

Located on the housing and shown in further detail in FIG. 3 is one example of the insulating flange 16 that can be used in the present invention. This insulating flange receives the water drain device 14 (illustrated in FIGS. 1 and 4). The insulating flange 16 is provided with an aperture 36 and a plurality of slits 34. The aperture receives the water drain device while the slits allow the insulating flange to accept and accommodate any size water drain device. The insulating flange can be made out of any polymer, such as rubber or plastic.

Figure 4:
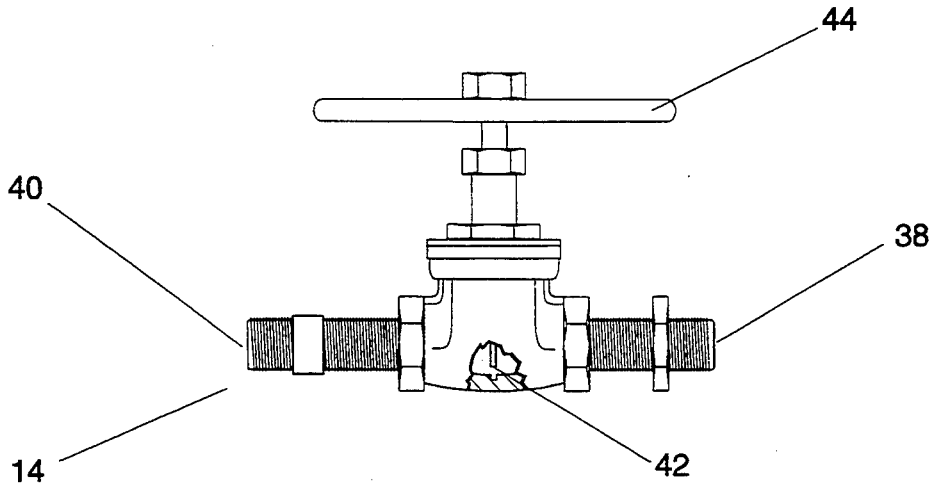
FIG. 4 is a detailed view of a water drain device used for the hot water tank assembly of the present invention.

FIG. 4 illustrates a detailed view of one example of a water drain device that can be utilized in the present invention. The water drain device 14 consists of a first end 38 and a second end 40. The first end is received in the aperture 36 of the insulating flange 16 and must be threaded. This first end extends from the inner metal layer 28, the fiberglass insulation layer 30 and the second metal layer 32 of the housing of the hot water tank assembly (not illustrated). In addition, the inner metal layer of the housing of the hot water tank assembly is provided with an opening for receiving the water drain device (not illustrated). The second end of the water drain device is located on the outside of the housing (see FIG. 1) and is also threaded. This second end is threaded to allow for a conventional standard hose to be attached during the draining process.

Situated in the middle of the water drain device 14 is a valve 42. In order to drain the hot water heater, a handle 44 located on the water drain device is turned counter-clockwise to lift and open the valve. This permits the water located within the hot water tank to escape through the second end 40 of the water drain device. Once the water is drained and the hot water tank is cleaned, the handle on the water drain device is turned clockwise in order to close the valve. The valve can be fabricated from any durable material such as synthetic resin, metal or metal alloy. Brass is an ideal material to utilize for the drain device because of its high resistance to corrosion.

Additionally, the first end and second end of the water drain device 14 can be horizontally aligned. This will allow easy access to clean and remove debris and sediment that might be located in the water drain device.

Figure 5A:
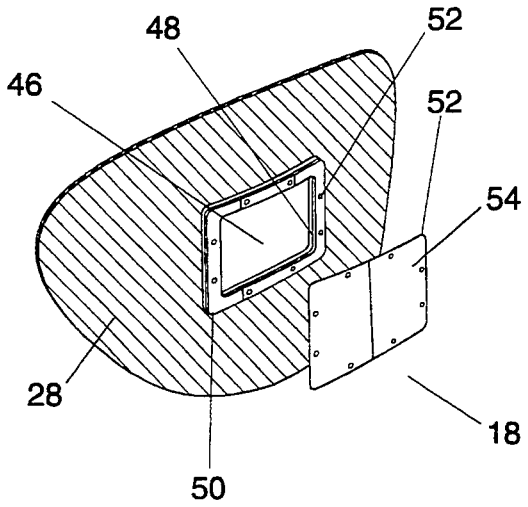
FIG. 5*a* is an isometric view of the access port provided on the hot water tank assembly of the present invention.

The access port, illustrated in the isometric view in FIG. 5*a*, allows for the hot water heater to be cleaned efficiently and quickly. The access port 18 consists of a first opening 46, a metal frame 48, a gasket 50, and a first cover 54. The opening 46 is provided in the inner metal layer 28.

The metal frame 48, which has a minimal thickness of 3/16 of an inch, is permanently attached to the edges of the opening 46. A first set of holes (not illustrated) are located in the metal frame. This first set of holes is threaded. Located on the metal frame 48 is a gasket 50 having the same shape as the metal frame. A second set of holes 52, aligned with the first set of holes, is located on the gasket. The gasket acts as a sealing means and prevents the water from the hot water tank from leaking out of the opening 46.

A first cover 54 is attachable to the gasket and the main frame. The first cover has a third set of holes (also labeled as 52) which is aligned with the first and second set of holes. Threaded fasteners are inserted in the first, second, and third set of holes in order to attach the first cover to the first opening. Removing the threaded fasteners detaches the first cover from the first opening.

Figure 5B:
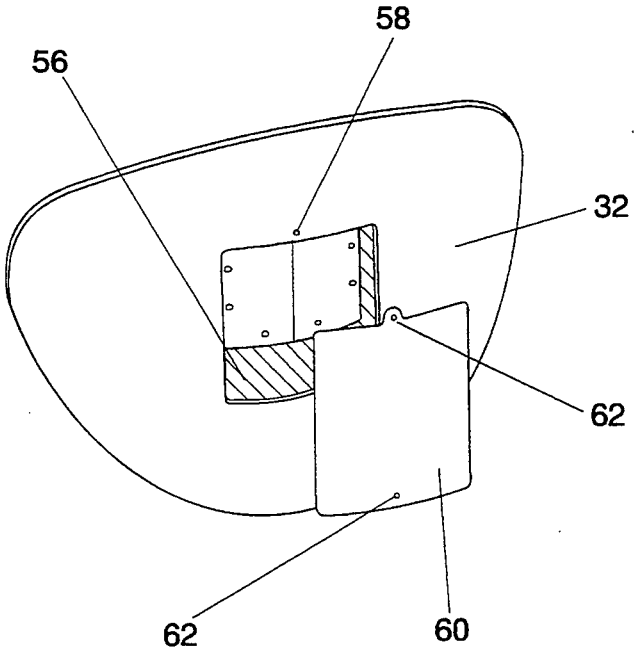
FIG. 5*b* is an isometric view of the second cover used to shelter the access port.

FIG. 5*b* illustrates the isometric view of a second cover 60 used to shelter and protect the access port. As illustrated in this figure, a second opening 56 is provided in the outer metal layer 32. This second opening is larger than the first opening and access port. Located above and below the second opening are first holes A second cover 60 is attachable to and detachable from the second opening. Second holes 62 are located on the second cover 60 and are aligned with the first holes located above and below the second opening. Treaded fasteners are inserted in the first holes and second holes in order to attach the second cover to the second opening. Removing the threaded fasteners detaches the second cover for the second opening.

In order to clean the hot water heater, a hose is threadably attached to the second end of the drain device 14. The handle on the drain device 14 (illustrated in FIGS. 1 and 4) is then turned to open the valve and to allow the water in the hot water tank to flow out. The second cover is then removed from the outer metal layer to expose the access port. The first cover is then detached from the inner metal layer to expose the interior of the hot water tank. The sediment and debris accumulated within can then be removed from the interior of the hot water tank. This prolongs the life span of the heating element as well as the hot water tank assembly.

If light is required to see within the interior of the hot water tank, then the water drain device can be removed and a conventional flashlight can be inserted into the aperture of the insulating flange. The slits located on the insulating flange provide an adequate means for accommodating various sized flashlights. Additionally, the insulating flange can also be removed in order to provide for another means for using a conventional flashlight when cleaning the hot water tank assembly.

The hot water tank assembly illustrated in FIG. 1 provides a comfortable means for a right-handed individual when utilizing a flashlight to assist in the removal of the debris from the hot water tank. In order to accommodate a left handed individual, an alternative or second embodiment is provided for the present invention.

Figure 6:
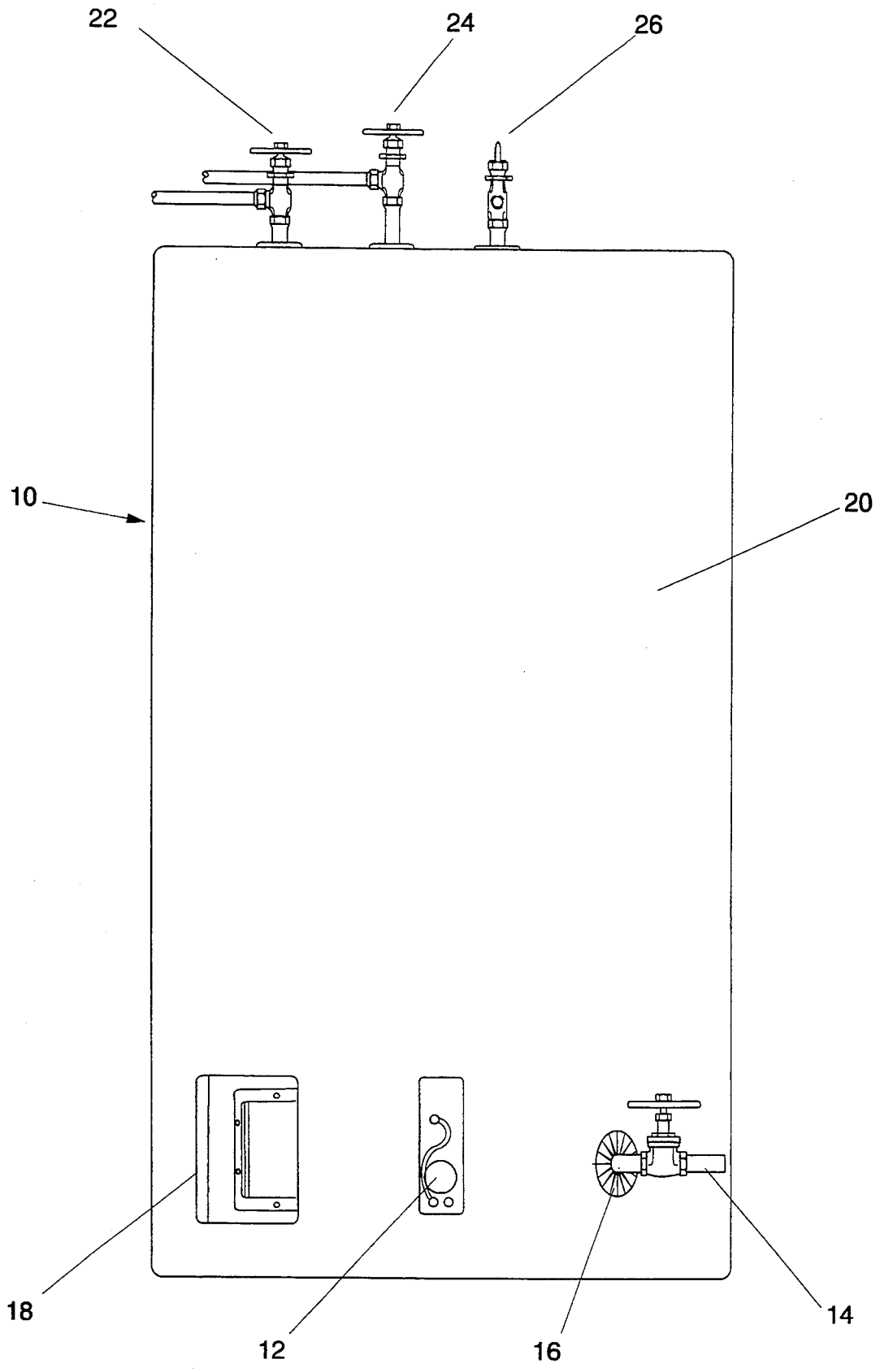
FIG. 6 is a front elevation view of the second embodiment of the hot water tank assembly of the present invention.

FIG. 6 illustrates the second embodiment of the present invention. As shown in this figure, the hot water tank assembly 10 consists of a conventional heating element 12, a water drain device 14, an insulating flange 16, an access port 18, a housing 20, a water inlet valve 22, a water outlet valve 24 and a safety valve 26.

The water drain device is provided on the right side of the heating element and the access port is provided on the left side of the heating element. This arrangement provides for a comfortable means for cleaning the hot water heater for a left-handed individual. This second embodiment operates and functions in the same manner as the first embodiment illustrated in FIGS. 1–5*b*. Additionally the components (heating element, water drain device, insulating flange, access port, housing, water inlet valve, water outlet valve and safety valve) are identical in shape and design as the components in the first embodiment.

Figure 7A:
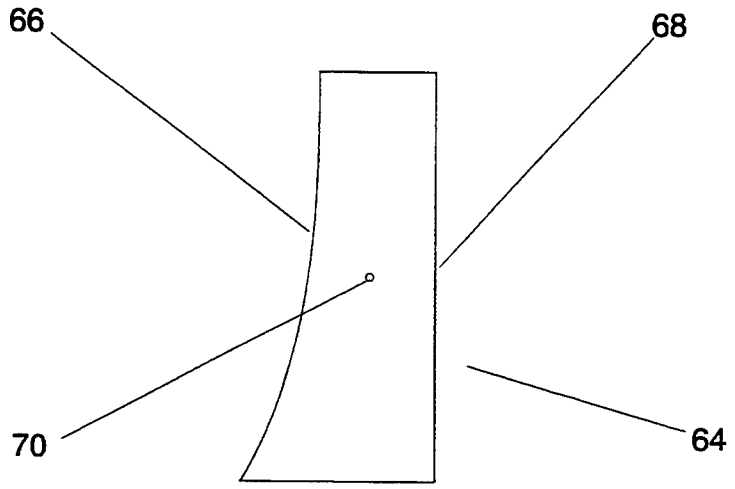
FIG. 7*a* is a front elevation view of a hot water tank assembly cleaning tool of the present invention.
Figure 7B:
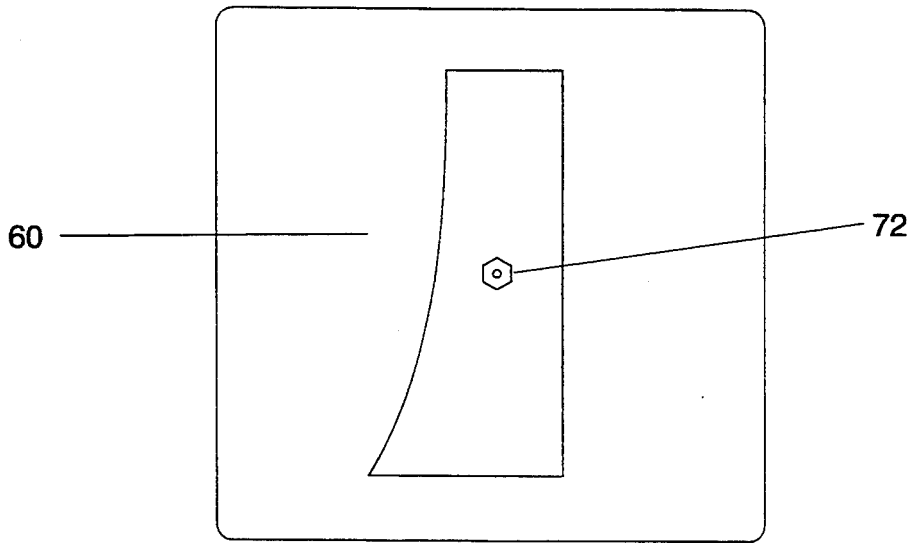
FIG. 7*b* is an elevation view of the tool attached to the back of the second cover.

A specialized tool can be used to help in cleaning and removing the sediment from the hot water tank assembly. The specialized tool is illustrated in detail in FIGS. 7*a* and 7*b*. As seen in these figures, the tool 64 has a unique shape and configuration. The tool has a first side 66 and a second side 68. The first side has a curved shape in order to conform with the convex bottom of the hot water tank housing. The second side 68 is straight and provides a comfortable means for holding the tool. The tool can also include a centrally located hole 70. This centrally located hole allows for a fastener 72 to attach the tool 64 to the back of the second cover 60.

While the invention has been particularly shown and described with reference to an embodiment thereof, it will be understood by those skilled in the art that various changes in form and detail may be made without departing from the spirit and scope of the invention.

I claim:

1. A hot water tank assembly comprising:

a cylindrical housing;

said cylindrical housing includes a top area, a middle area and a bottom area;

said cylindrical housing has an enclosed bottom end and an enclosed top end;

said cylindrical housing includes an inner metal layer and an outer metal layer;

an insulating layer is located between said inner metal layer and said outer metal layer;

a water inlet valve, a water outlet valve and a safety valve are located on said enclosed top end of said cylindrical housing;

an access port;

said access port is located on said bottom area of said cylindrical housing;

said access port includes a first opening, a second opening, a metal frame, a gasket, a first cover, and a second cover;

said first opening is located in said inner metal layer of said cylindrical housing;

said first opening has a perimeter;

said metal frame surrounds said perimeter of said first opening;

said gasket is located on said metal frame;

said gasket has the same shape, size, and configuration as said metal frame;

said first cover is attachable to and detachable from said inner metal wall, said metal frame, and said gasket by a first attachment means;

said second opening is located in said outer layer of said cylindrical housing and said insulating layer;

said second opening is larger than said first opening;

said second cover is attachable to and detachable from said outer metal layer by a second attachment means;

a heating element;

said heating element is provided in said bottom area of said cylindrical housing;

an insulating flange;

said insulating flange is located on said bottom area of said cylindrical housing;

said insulating flange is located on said outer metal layer of said cylindrical housing;

said insulating flange has an aperture and a plurality of slits on provided on said insulating flange and surround said aperture;

a water drain device;

said water drain device is received in said aperture of said insulating flange;

said water drain device has a first end and a second end;

said first end is received in said insulating flange;

said second end is located outside said cylindrical housing;

said first end of said water drain device is threaded and is adapted to be removable from and attachable to said cylindrical housing for enabling a light source to be inserted into said aperture of said insulating flange for interiorly lighting said bottom area of said inner metal layer;

a valve is located between said first end and said second end; and an actuation means for opening or closing said valve.

2. The hot water tank assembly as in claim 1 wherein said access port is located to the right of said heating element and said insulating flange with said water drain device located to the left of said heating element.

3. The hot water tank assembly as in claim 1 wherein said access port is located to the left of said heating element and said insulating flange with said water drain device is located to the right of said heating element.

4. The hot water tank assembly as in claim 1 wherein said water drain device is constructed from brass.

5. The hot water tank assembly as in claim 1 wherein said actuation means for opening and closing said valve is located outside said cylindrical housing.

6. The hot water tank assembly as in claim 1 wherein said metal frame has a first set of holes;

said inner layer of said cylindrical housing has a second set of holes;

said second set of holes is aligned with said first set of holes;

said gasket has a third set of holes;

said third set of holes is aligned with said first set of holes and said second set of holes;

said first cover has a fourth set of holes;

said fourth set of holes is aligned with said first set of holes, said second set of holes, and said third set of holes;

said first set of holes are threaded; and said first attachment means is a plurality of threaded fasteners which are insertable to and removable from said first set of holes, said second set of holes, said third set of holes, and said fourth set of holes.

* * * * *